US009266695B2

(12) United States Patent
Hikichi

(10) Patent No.: US 9,266,695 B2
(45) Date of Patent: Feb. 23, 2016

(54) PRINTING SYSTEM, CONTROL METHOD THEREOF, AND STORAGE MEDIUM

(71) Applicant: CANON KABUSHIKI KAISHA, Tokyo (JP)

(72) Inventor: Yukiyoshi Hikichi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/090,566

(22) Filed: Nov. 26, 2013

(65) Prior Publication Data

US 2015/0145200 A1 May 28, 2015

(30) Foreign Application Priority Data

Nov. 30, 2012 (JP) ..... 2012-262218

(51) Int. Cl.

| | |
|---|---|
| ***B65H 43/06*** | (2006.01) |
| ***B65H 33/00*** | (2006.01) |
| ***B65H 31/00*** | (2006.01) |
| ***B65H 29/50*** | (2006.01) |

(52) U.S. Cl.

CPC ..... *B65H 43/06* (2013.01); *B65H 29/50* (2013.01); *B65H 31/00* (2013.01); *B65H 33/00* (2013.01); *B65H 2511/152* (2013.01); *B65H 2601/525* (2013.01)

(58) Field of Classification Search

CPC ..... B65H 29/18; B65H 29/22; B65H 29/50; B65H 43/06; B65H 31/10; B65H 2511/152; B65H 2601/42; B65H 2601/52; B65H 2601/525

See application file for complete search history.

(56) References Cited

U.S. PATENT DOCUMENTS

| | | | | |
|---|---|---|---|---|
| 5,950,037 | A | 9/1999 | Ko | |
| 8,864,134 | B2 * | 10/2014 | Tachibana | 271/299 |
| 2003/0085506 | A1 * | 5/2003 | Kubo | 271/117 |
| 2010/0148421 | A1 * | 6/2010 | Tachibana | 271/3.17 |
| 2011/0316225 | A1 * | 12/2011 | Takahashi | 271/207 |

FOREIGN PATENT DOCUMENTS

| | | | |
|---|---|---|---|
| CN | 1439946 | A | 9/2003 |
| CN | 201292175 | Y | 8/2009 |
| CN | 102152668 | A | 8/2011 |
| CN | 102582291 | A | 7/2012 |
| JP | H11-322155 | A | 11/1999 |
| JP | 2002-003079 | A | 1/2002 |
| JP | 2004-034577 | A | 2/2004 |
| JP | 2006-157530 | A | 6/2006 |
| JP | 2010-189148 | A | 9/2010 |
| JP | 2012-020842 | A | 2/2012 |

* cited by examiner

*Primary Examiner* — Michael McCullough

(74) *Attorney, Agent, or Firm* — Canon U.S.A., Inc. IP Division

(57) ABSTRACT

A system is provided for shifting, according to an amount of stacked sheets that has been stacked in a sheet stacking device, a state of a power to be supplied to the sheet stacking device from a first power state to a second power state where power consumption is less than that in the second power state.

4 Claims, 11 Drawing Sheets

| | POWER SOURCE STATUS OF EACH UNIT | | | |
|---|---|---|---|---|
| ACTION SHIFT CONDITION | MAIN CONTROLLER | PRINTER CONTROLLER | STACKER | SADDLE STICH BOOK-BONDING MACHINE |
| JOB IN OPERATION STATE | ON | ON | ON | ON |
| STACKER FULLY LOADED WITH SHEETS | ON | ON | SLEEP | ON |
| INCAPABLE OF PERFORMING OUTPUT TO ALL OUTPUT DESTINATION | SLEEP | SLEEP | SLEEP | SLEEP |
| TIME OUT OF SLEEP TIMER | SLEEP | SLEEP | SLEEP | SLEEP |
| WHEN STACKER DOOR IS OPENED | ON | ON | ON | ON |
| TIME OUT OF SHUT DOWN TIMER | OFF | OFF | OFF | OFF |

FIG. 4

| | 6001 | 6002 | 6003 | 6004 |
|---|---|---|---|---|
| ACTION MODE | OFF STATE | SLEEP (ONLY A PART OF CONTROLLER ACTS) | POWER SAVE MODE (ONLY CONTROLLER ACTS) | JOB IN OPERATION STATE |
| POWER CONSUMPTION | APPROXIMATELY 0 W | 2 WS OR LESS | SEVERAL WS TO APPROXIMATELY 20 WS | 2 KWS OR MORE |

FIG. 6

| | POWER SOURCE STATUS OF EACH UNIT | | | |
|---|---|---|---|---|
| ACTION SHIFT CONDITION | MAIN CONTROLLER | PRINTER CONTROLLER | STACKER | SADDLE STICH BOOK-BONDING MACHINE |
| JOB IN OPERATION STATE | ON | ON | ON | ON |
| STACKER FULLY LOADED WITH SHEETS | ON | ON | SLEEP | ON |
| INCAPABLE OF PERFORMING OUTPUT TO ALL OUTPUT DESTINATION | SLEEP | SLEEP | SLEEP | SLEEP |
| TIME OUT OF SLEEP TIMER | SLEEP | SLEEP | SLEEP | SLEEP |
| WHEN STACKER DOOR IS OPENED | ON | ON | ON | ON |
| TIME OUT OF SHUT DOWN TIMER | OFF | OFF | OFF | OFF |

PRINTING SYSTEM, CONTROL METHOD THEREOF, AND STORAGE MEDIUM

BACKGROUND

1. Field

Aspects of the present invention generally relates to a printing system, a control method thereof, and a storage medium.

2. Description of the Related Art

Reducing power consumption of printing devices such as digital multi-function processing machines which perform image forming processing has been strongly demanded. To satisfy the demand, the digital multi-function processing machines in recent years have been mounted with various types of low power consumption functions. As one of the low power consumption functions, an automatic sleep function is adopted. After the digital multi-function processing machine has finished a job such as printing, when the job is not performed for a predetermined time, the digital multi-function processing machine automatically shifts to a sleep mode to reduce the power consumption. In the sleep mode, in addition to stopping a toner fixing heater and energization of an engine motor, the digital multi-function processing machine stops a central processing unit (CPU) for controlling the machine to reduce the power consumption. Another power saving function is an automatic shut-down function. Similarly to the automatic sleep function, the automatic shut-down function automatically turns off the power source when a predetermined time elapses after the job has been finished. With this function, the power consumption can become almost zero.

As a conventional technique, Japanese Patent Application Laid-Open No. 2006-157530 discusses a control method for stopping sheet discharging action when it is detected that a sheet discharge port is fully loaded with discharged print sheets. Japanese Patent Application Laid-Open No. 2006-157530 discusses that, in a device for reading a paper document as electronic information by a scanner, when it is detected that the discharged sheets that have been scanned are fully loaded, and when a finishing process is selected, the sheet discharging action is finished. Further, when waiting is selected as the processing method, the device is controlled to be set to a waiting state and wait for release of a fully loaded state of the sheet discharge port. In the waiting state, when an image reading device is in an energy saving mode, a driving unit of the image reading device can be stopped.

However, according to the conventional technique, the power saving function such as the automatic sleep function and the automatic shut-down function shifts to a power saving mode after a previously set time elapses. Thus, even when the print sheets being fully mounted is detected and the print action cannot be performed, until the set time elapses, the device cannot shift to a low power consumption state. Therefore, even when the printing device cannot be used, an unnecessary power is consumed. Further, according to the technique discussed in Japanese Patent Application Laid-Open No. 2006-157530, even though fully loaded discharged sheets are detected and thus the driving unit is stopped, since the energization is continued through units other than the driving unit, the unnecessary power is consumed more than in the low power consumption state.

SUMMARY

According to an aspect of the present invention, a printing system including a sheet stacking device for stacking sheets discharged from a printing device includes an obtaining unit configured to obtain an amount of stacked sheets from the sheet stacking device, a determination unit configured to determine whether the amount of the stacked sheets exceeds a predetermined amount, and a control unit configured to cause, when it is determined that the amount of the stacked sheets exceeds the predetermined amount, a power state of the sheet stacking device to shift from a first power state to a second power state where power consumption is less than that in the first power state.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 illustrates a power saving state of the printing system illustrated in FIG. 3.

FIG. 6 illustrates operations for shifting a power supply state of the printing system.

DESCRIPTION OF THE EMBODIMENTS

Various exemplary embodiments, features, and aspects of the embodiments will be described in detail below with reference to the drawings.

<Description of System Configuration>

Figure 1:
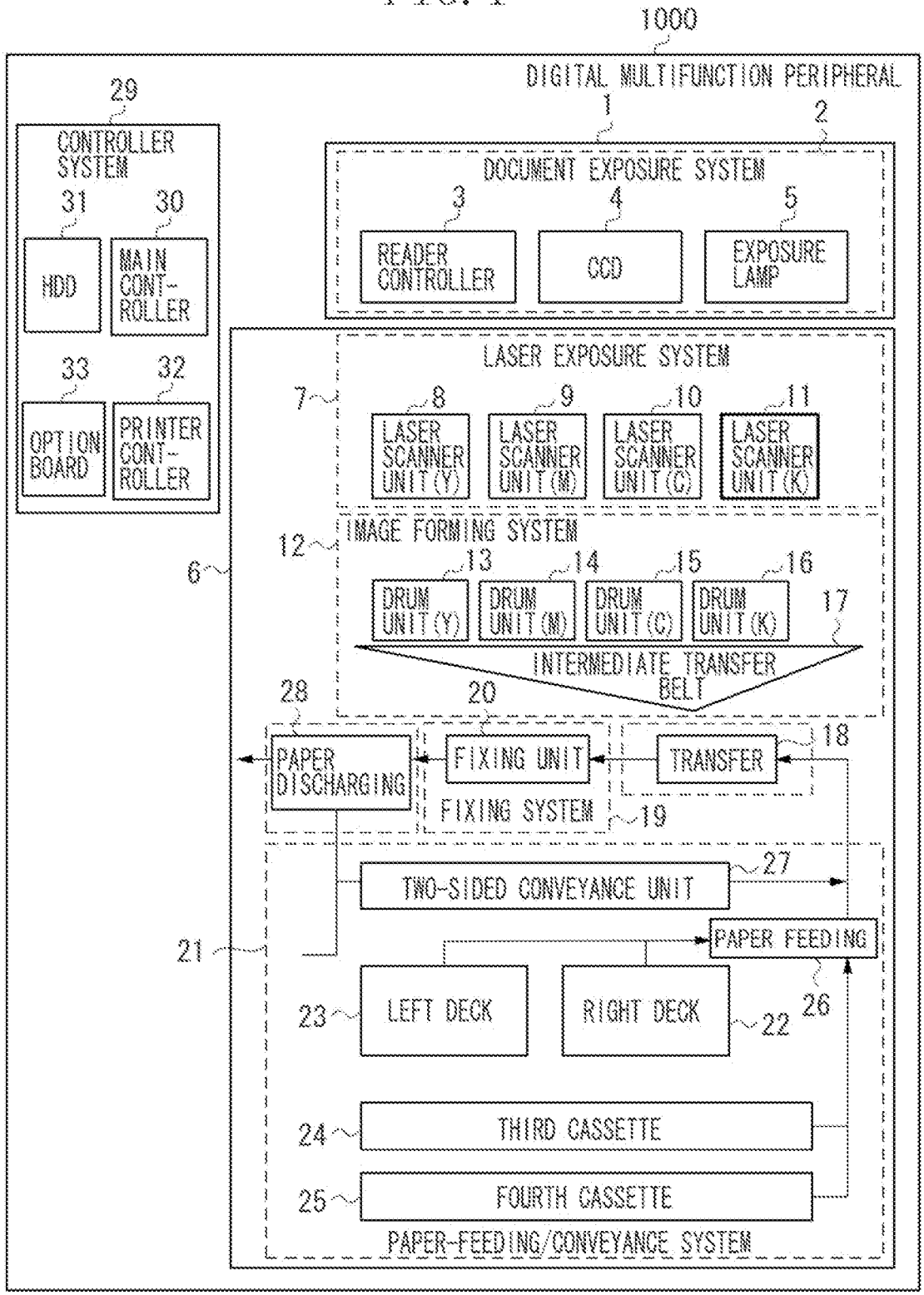
FIG. 1 is a cross-sectional view of a digital multi-function processing machine to which a printing device is applied.

A function of a digital multi-function processing machine will be described as one exemplary embodiment of a printing system. The digital multi-function processing machine includes an image reader for reading a paper document and a laser printer for forming an image by an electro-photographic method. FIG. 1 is a cross-sectional view of the digital multi-function processing machine illustrating an example of a printing device according to a present exemplary embodiment. As a function configuration, the digital multi-function processing machine according to the present exemplary embodiment is formed of roughly six blocks described below. More specifically, the six blocks include a document exposure system, a controller system, a laser exposure system, an image forming system, a fixing system, and a sheet feeding/conveyance system. As described with reference to FIG. 3 below, the printing device according to the present exemplary embodiment can establish the printing system by connecting to a sheet processing device. The printing system will be described in detail with reference to FIG. 3.

As illustrated in FIG. 1, a controller system 29 includes a main controller 30, which is a control device including a CPU and a memory, and controls an entire digital multi-function processing machine according to a program stored in a hard disk drive (HDD) 31. A printer controller 32 controls a mechanism of a laser printer unit. The printer controller 32 controls machine components according to an instruction from the main controller 30 to obtain print output.

Further, the printer controller 32 communicates with an option accessary connected thereto to control the option accessary. The option accessary specifically refers to a stacker and a saddle stitch book-binding machine. An image reader 1 lights an exposure lamp 5 controlled by a reader controller 3 to read an image of a document by a charge coupled device (CCD) 4, and then converts it into digital data. A laser printer unit 6 forms an electric latent image on each drum unit of Y, M, C, and K in a image forming system 12 using four laser scanner units for Y, M, C, and K included in a laser exposure system 7. Each of the drum units for Y, M, C, and K includes a photosensitive drum and a developing unit in combination. The developing unit includes toner for forming an image and carrier for giving charge to the toner.

Forming image data which originates the electric latent image is transmitted by the main controller 30 to the laser exposure system 7. The data is document data read by the image reader 1 or page-description language (PDL) data received by the main controller 30 from a host computer. The main controller 30 has a network function, and thus can communicate with the host computer. As described above, the latent image formed on the photosensitive drum with the laser from the laser scanner unit forms the visual image when the toner from the developing unit adheres to the photosensitive drum. Subsequently, the toner is transferred onto an intermediate transfer belt 17, which is a photosensitive member in a belt-like shape. When all four-color toner in Y, M, C, and K of the image on a drum unit is transferred, a full-color toner image is formed on the intermediate transfer belt 17. Apart from the image forming system 12, a sheet-feeding conveyance system 21 will be described below.

A right deck 22, a left deck 23, a third tray 24, and a fourth tray 25 are sheet trays for storing print sheets. The right and left decks can store comparatively small-size sheets, and the third and fourth trays can store large-size sheets. Sheet feeding 26 is a mechanism for conveying the print sheet drawn from each sheet tray to the image forming system 12.

Figure 2:
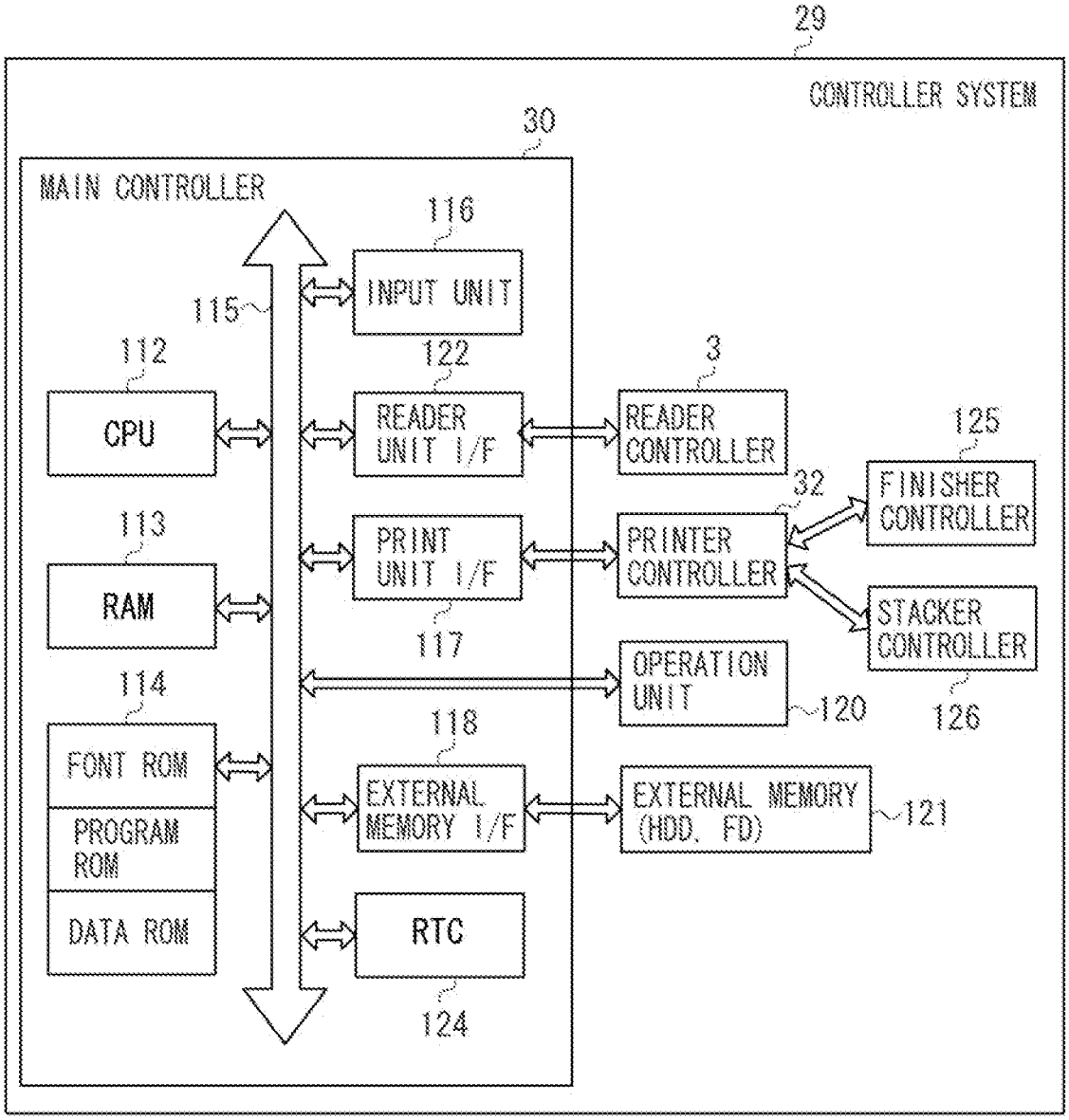
FIG. 2 is a block diagram illustrating a hardware configuration of a controller system.

When two-sided print is performed, the two-sided conveyance unit 27 can convey the sheet, with one printed, to the image forming system 12 again. When the print sheet drawn by the sheet-feeding conveyance system 21 is conveyed to a transfer unit 18 in the image forming system 12, the toner image formed on the intermediate transfer belt 17 is transferred onto the print sheet. Subsequently, the toner image heated and pressed by a fixing roller of a fixing unit 20 is firmly fixed onto the print sheet to be a printed matter. The printed sheet is conveyed to an outside of the printer via a sheet-discharging unit 28. FIG. 2 is a block diagram illustrating a hardware configuration of a controller system 29 illustrated in FIG. 1.

As illustrated in FIG. 2, the main controller 30 is a main feature of a printer control system, and provides a printer function using a print unit, an operation unit 120, and an external memory 121. A CPU 112 of the main controller 30 outputs an image signal as output information to the print unit (printer engine) interface (I/F) 117 connected to a system bus 115 based on a control program.

The control program is stored in a program read only memory (ROM) in a ROM 114 or the external memory 121. A font ROM in the ROM 114 stores font data used when the above-described output information is generated. A data ROM in the ROM 114 stores information used on the host computer when the printer does not include the external memory 121 such as the hard disk.

The printer controller 32 forms the print image by an electro-photographic process based on the image signal transmitted from the print unit I/F. When the printing device performs post-processing or loads the sheets, the printer controller 32 is connected to a finisher (saddle stitch book-binding machine) controller 125 or a stacker controller 126. The reader controller 3 reads the paper document as electronic data. The CPU 112 can read the electronic data of the reader controller 3 via a reader unit I/F 122.

The CPU 112 can perform communication processing with the host computer via an input unit 116, and can notify the host computer (not illustrated) of the information stored in the printer. A random access memory (RAM) 113 functions as a main memory and a work area of the CPU 112. The RAM 113 can expand a memory capacity by an option RAM to be connected to an expanded port (not illustrated). The RAM 113 is used for an output information development region, an environment data storage region, and a non-volatile random access memory (NVRAM). Access to the above-described hard disk (HD) and the external memory 121 such as an integrated circuit (IC) card is controlled by a memory controller (MC) 118.

The external memory 121 is connected as an option and stores the font data, an emulation program, and form data. Further, the operation unit 120 is provided with operation switches and a light-emitting diode (LED) display device. Furthermore, one or more external memories described above can be connected to the system. Namely, a plurality of external memories which stores, in addition to a built-in font, an option font card and a program interpreting printer control languages in different language systems can be included. Moreover, the external memory 121 may include the NVRAM (not illustrated) and may store printer mode setting information output from the operation unit 120.

A real time clock (RTC) 124 is a real time clock circuit and hardware for measuring time and counting the time at a predetermined interval. Since the RTC 124 operates while receiving the power supply from a built-in battery, even when the main controller 30 stops, the RTC itself can always act. According to values written into a register within the RTC from the CPU 112, an interruption signal is generated at a predetermined time or at a certain interval time to notify the wired CPU 112 of the interruption.

[Configuration Example of POD System of Digital Multiple Function Processing Machine]

Figure 3:
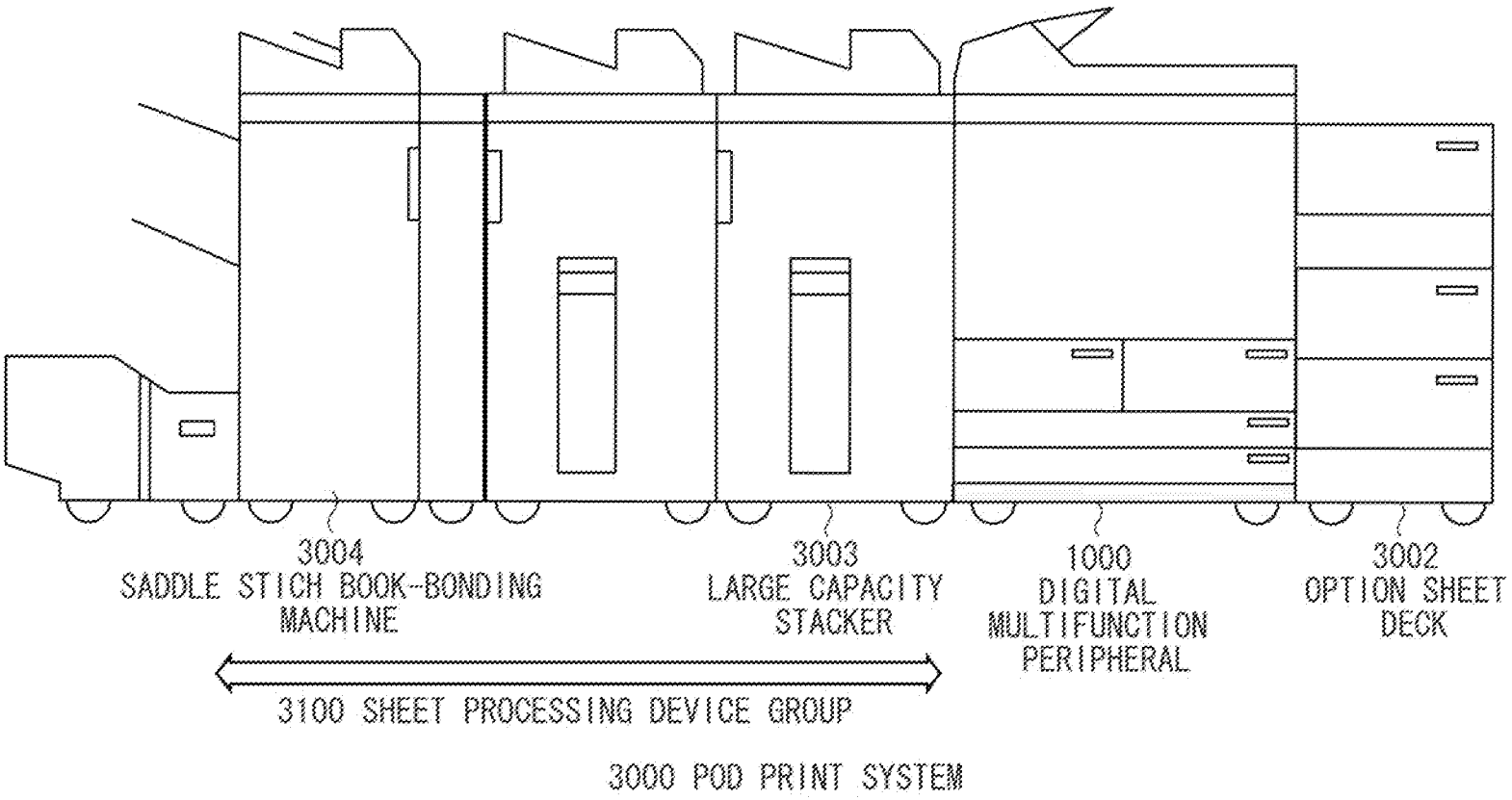
FIG. 3 illustrates a configuration of a printing system including the printing device illustrated in FIG. 1.

FIG. 3 illustrates a configuration of a printing system including the printing device illustrated in FIG. 1. FIG. 3 illustrates an example of a printing system in which the digital multi-function processing machines for a print on demand (POD) market are mounted with many finishing accessories. According to the example illustrated in FIG. 3, a printing system 3000 includes two large capacity stackers 3003, a saddle stitch book-binding machine 3004, and four sheet processing devices of an inline type in total, as a series of sheet processing device group 3100. An option sheet deck 3002 is used for supplying the sheets. The present exemplary embodiment describes the printing system including a sheet stacking device stacking the sheets discharged from the printing device, as an example. As illustrated in FIG. 3, the large capacity stacker 3003 is the sheet processing device capable of stacking a great number of sheets from the digital multi-function processing machine 1000. One stacker can stack 5,000 sheets and thus, when two stackers are connected to each other, a great number of 10,000 sheets can be stacked. A power supply state of the large capacity stacker 3003 is controlled by the printer controller 32. The large capacity stacker 3003 is dealt with as one of the devices which are to be shifted to the power saving state as described below. A condition for shifting the large capacity stacker 3003 to the power saving state will be described below.

The saddle stitch book-binding machine 3004 can selectively perform staple processing, punch processing, cutting processing, shift paper discharging, saddle stitch book-binding processing, folding processing on the sheets from the digital multi-function processing machine 1000. In the present exemplary embodiment, a method for the printing system which can sequentially perform a great amount of printing will be described which can reduce the power consumption without sacrificing productivity.

[Power Consumption Reducing Function]

Further, the printing system is mounted with various types of power consumption reducing functions. Specific action and the power consumption of each state will be described herein. FIG. 4 illustrates the power saving state of the printing system illustrated in FIG. 3. FIG. 4 illustrates an example list of each power consumption state and the power consumption. As illustrated in FIG. 4, each power consumption state (action mode) includes four types of states, which are an off state 6001, a sleep state 6002, a power saving mode (stand-by mode) 6003, and a job in operation state 6004. In the off state 6001, the power source is turned off. In other words, since the power is not supplied to the printing system, the power consumption is approximately 0 W. In the sleep state 6002, only a part of circuits in the controller such as the main controller 30, the printer controller 32, and the reader controller 3 is in operation. In the sleep state 6002, since only a part of circuits which detects a signal received via a network or interruption caused by pressing a power source button is in operation, only very small power of 2 W or less is consumed. In the power saving mode 6003, the printing system operates all controller circuits such as the printer controller 32 and stacker-controller control substrate 5002, however, the power supply to the device such as a motor and a solenoid consuming a great amount of power is cut.

As a result, in the power saving mode 6003, the power from several watts to approximately 20 W is consumed. In the job in operation state 6004, the print job is being performed. In the operation state 6004, when the job is started by receiving the print data from the host computer (not illustrated) or an operator's instruction via the operation unit 120, all circuits in the system perform actions. Since the fixing unit 20 generating a great amount of heat and all devices including a motor of the saddle stitch book-binding machine rotating at a high speed perform actions, the system consumes a great amount of power of 2 kW or more.

Figure 5:
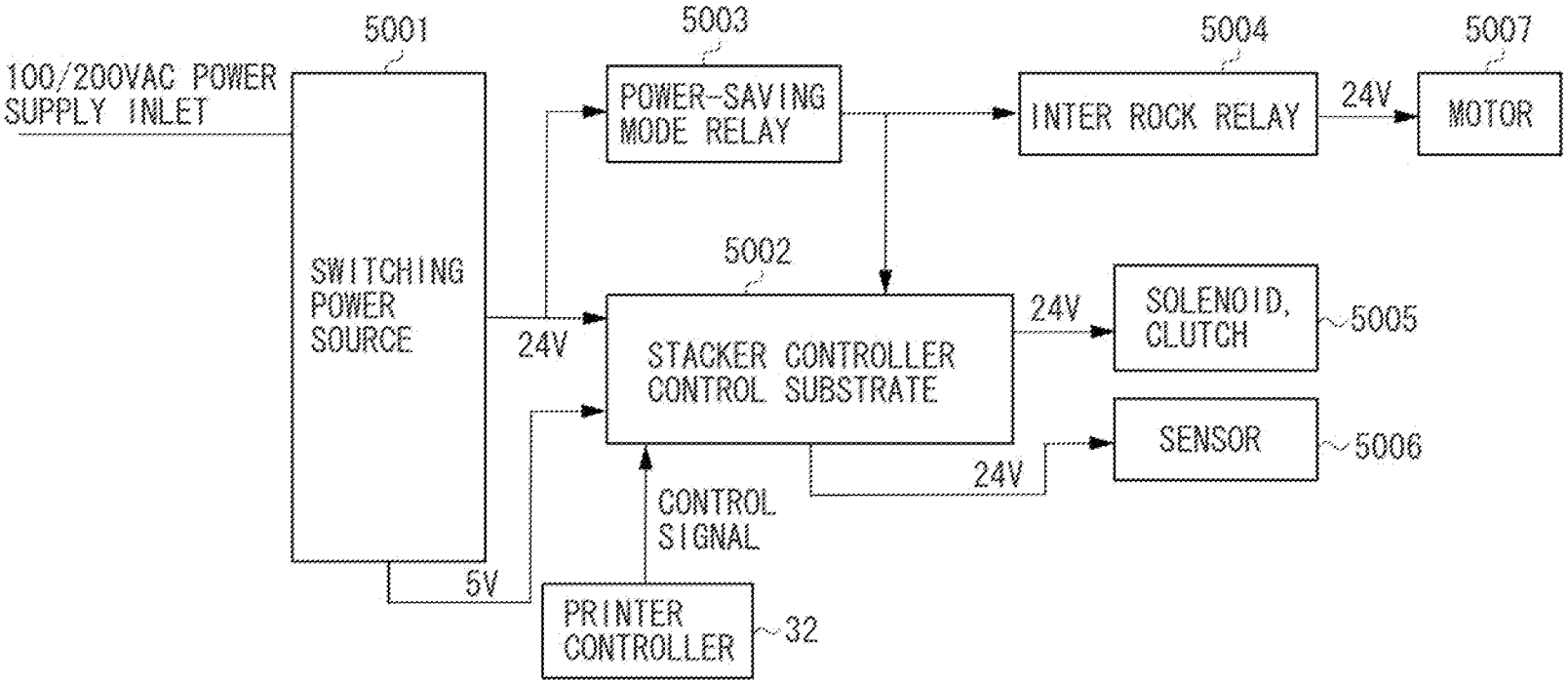
FIG. 5 is a block diagram illustrating a configuration of controlling power consumption of the printing system.

FIG. 5 is a block diagram illustrating a configuration of controlling the power consumption of the printing system according to the present exemplary embodiment. The electric circuit of the large capacity stacker 3003 is described as an example. As illustrated in FIG. 5, the power source of alternate current (AC) 100V or AC 200V is supplied to a switching power source 5001. The switching power source 5001 supplies the power of direct current (DC) 5V to the control system of the controller and the power of DC 24V to the motor.

A stacker-controller control substrate 5002 is a control board mounted with the circuit for controlling the stacker. A configuration of the stacker-controller control substrate 5002 (not illustrated) includes, in a similar manner to the main controller 30, a program ROM and the CPU for executing the program therein. To shift the large capacity stacker 3003 to each operation mode illustrated in FIG. 4, the printer controller 32 is connected to the stacker-controller control substrate 5002 via the control signal.

When shifting to the power saving mode is instructed by the printer controller 32, a power-saving mode relay 5003 is cut to stop the power supply to the devices including a motor 5007 connected to a subsequent stage of the relay, and a solenoid crutch 5005, and a sensor 5006. The present embodiment does not directly relate to an inter rock relay 5004, which is a circuit for urgent stop of the motor 5007 without passing through the control circuit when a cover is opened.

FIG. 6 illustrates actions for shifting the power supply state of the printing system 3000 illustrated in FIG. 3. FIG. 6 illustrates an example of how the power state is changed when each unit included in the printing system shifts the power consumption mode. According to the present exemplary embodiment, six conditions for shifting the power consumption mode are provided as below. More specifically, six conditions include the job in progress, detection of fully loaded stacker, incapable of outputting print sheets to all output destinations, time out of sleep timer, stacker door open, and time out of shut-down timer.

As illustrated in FIG. 6, when the job is in operation, all units enter an active state which consumes a maximum power. Next, the time that the stacker is fully loaded with the sheets will be described. When the number of the sheets physically exceeds the number of the sheets which the stacker can stack or, when the number of sheets reaches the maximum number of sheets set by software that can be stacked, the large capacity stacker 3003 stops a stacking action to notify the printer controller 32 of full load of the sheets. At this point, since the stacker cannot be used, the main controller 30 shifts the large capacity stacker 3003 to the sleep state via the printer controller 32. With this arrangement, the power unnecessary for the unit that cannot be used for the printing is not consumed. Since other units (including the digital multi-function processing machine 3001 and the saddle stitch book-binding machine 3004) included in the printing system 3000 can be used in the subsequent job, an on state is maintained as it is.

The power source state of each unit when all output destinations included in the printing system 3000 are used as the output destination will be described. When both two large capacity stackers 3003 are fully loaded with the sheets, and all output pins of the saddle stitch book-binding machine 3004 are also fully loaded with the sheets, the POD printing system cannot continue to perform the printing. At this point, the main controller 30 shifts the large capacity stacker 3003 and the saddle stitch book-binding machine 3004 to the sleep state via the printer controller 32. After the main controller 30 shifts the printer controller 32 to the sleep state, the main controller 30 shifts itself to the sleep mode too.

Time out of the sleep timer will be described below. The main controller 30 has a sleep timer specified by the operation unit 120. When asleep time set by using an internal clock elapses, the all units in the printing system 3000 are shifted to the sleep state.

Stacker door opening will be described below. To remove the stacked print sheet from the large capacity stacker 3003, the large capacity stacker 3003 needs to be in the "on" state. When the all units in the printing system are in asleep state, and when the main controller 30 detects that an operator has pressed the power source button on the operation unit 120, the all units of the printing system are returned to the "on" state.

Finally, the time out of the shut-down timer will be described. The main controller 30 includes the shut-down timer specified by the operation unit 120. In a similar manner to the sleep timer, whether the shut-down time has elapsed is monitored using the internal clock, and when the job or an operation of the operation unit are not performed within a set time, the shut-down is performed. When the shut-down is performed, the main controller 30 stops all power source circuits in the printing system 3000. Since a physical power source switch is also turned off by a relay circuit, to use the printing system 3000 again, an operator needs to return the physical power source switch to an "on" position.

[Method for Controlling Sheet Loading of Large Capacity Stacker]

Figure 7:
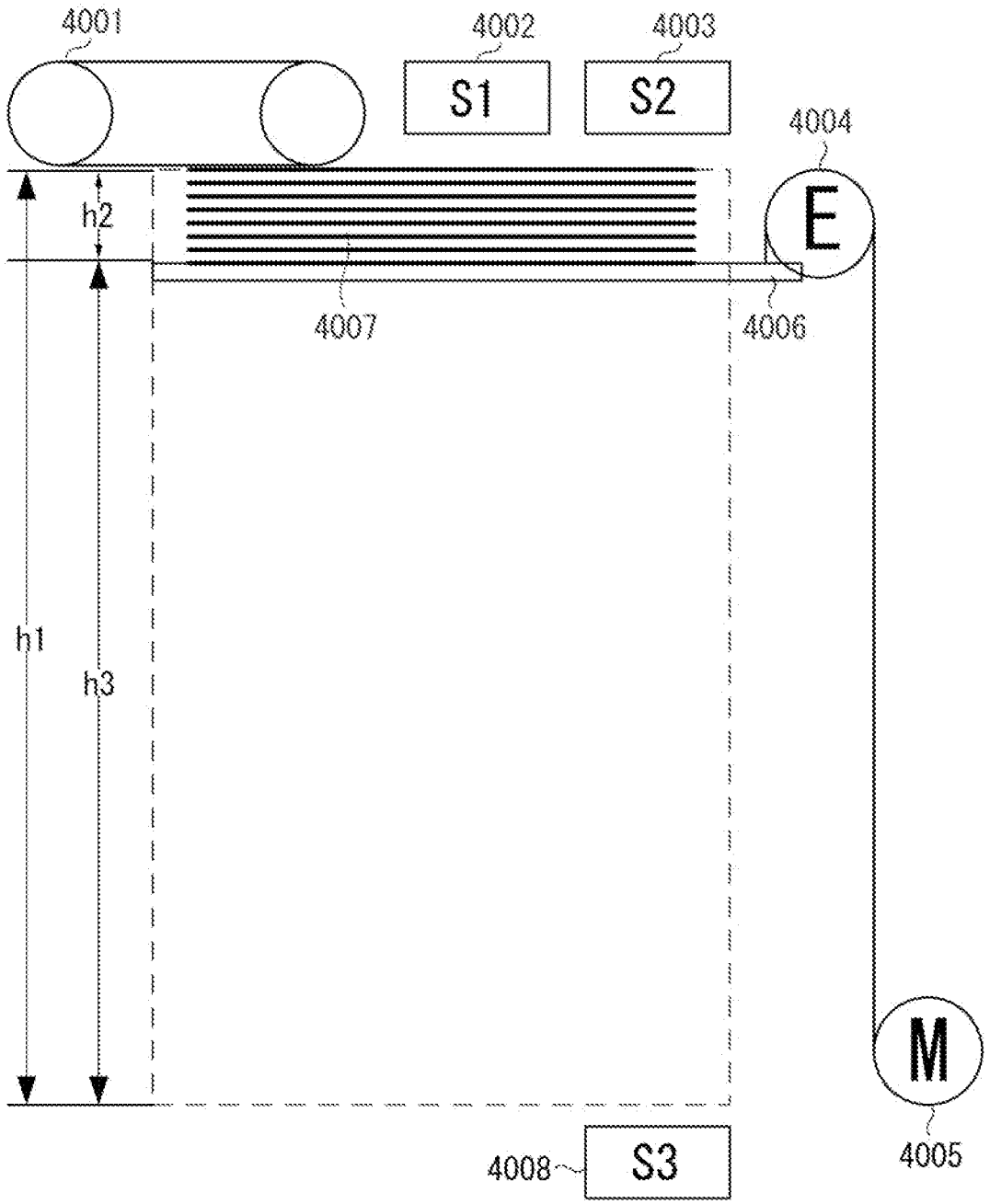
FIG. 7 is a cross-sectional view of a configuration of a stack tray unit of a large capacity stacker illustrated in FIG. 3.

A method for stacking the sheets and detecting full load of the large capacity stacker 3003, and a configuration of the large capacity stacker 3003 will be described. FIG. 7 is a cross sectional view illustrating a configuration of a stack tray unit of the large capacity stacker 3003 illustrated in FIG. 3. As illustrated in FIG. 7, a lifter motor 4005 lifts or lowers a tray lifter 4006 and print sheets 4007 stacked thereon. The lifter motor 4005 and the tray lifter 4006 are connected to each other with a wire via a pulley. An encoder 4004 is connected to the pulley. How much the pulley is rotated is measured by the encoder 4004, and thus how much the tray lifter 4006 is lifted can be known.

A sheet-face detection sensor 4002 detects an upper face of a print sheet 4007, and a sheet sensor 4003 determines whether there is any print sheet on the tray lifter 4006. A lifter lower-limit sensor 4008 detects that the tray lifter 4006 is located at a lower limit. The tray lifter 4006 is lowered to the lower limit when the tray is opened. A conveyance roller 4001 conveys the print sheets to load them one by one on the tray lifter 4006.

When the lifter lower-limit sensor 4008 reacts, the number of accumulated pulses of the encoder 4004 is reset to "0". Subsequently, the tray lifter 4006 starts to lift by the lifter motor 4005. When the sheet-face detection sensor 4002 reacts, it is determined that the tray lifter 4006 reaches a position where the sheets can be stacked, and thus the lifter motor 4005 stops. A height h2 of the stacked sheets is calculated based on the number of accumulated pulses of the encoder 4004. Further, a height h3 of the sheets for additional sheets can be calculated based on a height h1 of sheet storage within the tray, which is a set value.

To empty space to stack the sheets, the tray lifter 4006 is lowered again until the sheet-face detection sensor 4002 stops reaction. When the print job is started and the sheets are stacked on the tray lifter 4006 by the conveyance roller 4001, the sheet-face detection sensor 4002 reacts. Subsequently, the tray lifter 4006 is lowered again until the sheet-face detection sensor 4002 does not react. The actions of stacking and lowering are repeatedly performed until the lifter lower-limit sensor 4008 reacts. When the lifter lower-limit sensor 4008 reacts, it is notified to the main controller 30 that the large capacity stacker 3003 detects via the printer controller 32 that the sheets has been fully loaded.

[Processing Sequence when Sheet Discharging Destination of Print Job is Stacker]

Figure 8:
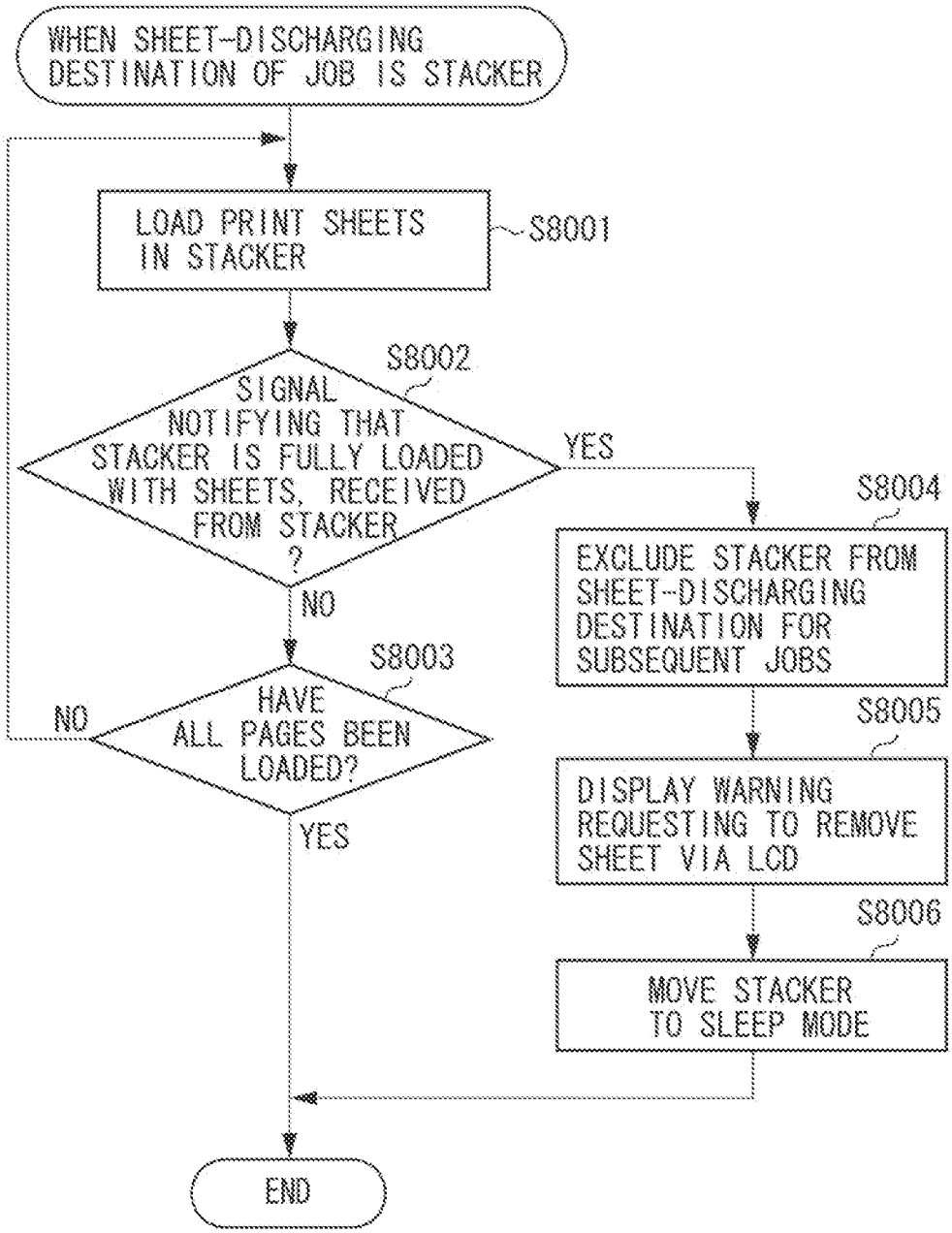
FIG. 8 is a flowchart illustrating a control method of the printing device.

FIG. 8 is a flowchart illustrating a control method of the printing device according to the present exemplary embodiment. FIG. 8 illustrates an example of print processing of the digital multi-function processing machine 1000 in the printing system 3000 illustrated in FIG. 3. Particularly, a processing sequence when a sheet discharging destination is the large capacity stacker 003 will be described. The program of the digital multi-function processing machine 1000 described in the flow is stored in the program ROM of the main controller 30 or the external memory 121 such as the HDD 31, and read out to the RAM 113 to be executed by the CPU 112. When an amount of stacked sheets is obtained from the large capacity stacker 3003, which is an example of the sheet stacking device, and when it is determined that the amount of the stacked sheets exceeds the sheet stacking condition, a state of the power supplied from the power source to the large capacity stacker 3003 is controlled to shift to the power saving state. The control will be described below. The sheet stacking condition is determined according to a maximum number of stacking sheets that can be stacked and set on the large capacity stacker 3003. Further, the maximum number of stacked sheets can be individually set according to a thickness of the sheet. Furthermore, according to the example illustrated in FIG. 8, particularly when it is determined that the amount of the stacked sheets obtained during the print processing of the printing device exceeds the sheet stacking condition, a state of the power to be supplied to the large capacity stacker 3003 from the power source is shifted to the power saving state.

First, the main controller 30 forms an image on the print sheet by the electro-photographic process using the digital multi-function processing machine 1000. In step S8001, according to an instruction from the printer controller 32, the stacker controller 126 loads the print sheets onto the large capacity stacker 3003. The large capacity stacker 3003 stacks one sheet, and then lowers the tray lifter 4006. At this point, in step S8002, the large capacity stacker 3003 determines whether the tray lifter 4006 reacts the lifter lower-limit sensor 4008 to detect whether the large capacity stacker 3003 is fully loaded with the sheets. When the lifter lower-limit sensor 4008 does not detect that the large capacity stacker 3003 is fully loaded with the sheets (NO, in step S8002), then in step S8003, the main controller 30 continues the print job until the processing is performed on all pages. On the other hand, when the lifter lower-limit sensor 4008 detects that the large capacity stacker 3003 is fully loaded with the sheets (YES in step S8002), the main controller 30 recognizes that the large capacity stacker 3003 cannot be used as the output destination of the job.

In step S8004, the RAM 113 memorizes that the large capacity stacker 3003 cannot be used, in output capable destination list information managed by the main controller 30. Subsequently, since communication cannot be performed if the large capacity stacker 3003 is set to the sleep state, the main controller 30 needs to store the information itself. In step S8005, the main controller 30 displays a guidance for removing the sheets stacked in the large capacity stacker 3003 via a liquid crystal display (LCD) panel on the operation unit 120. Finally, in step S8006, the main controller 30 shifts the large capacity stacker 3003 to the sleep mode to end the processing.

[Processing Sequence when Sheet Discharging Destination of Print Job is Saddle Stitch Book-Binding Machine]

Figure 9:
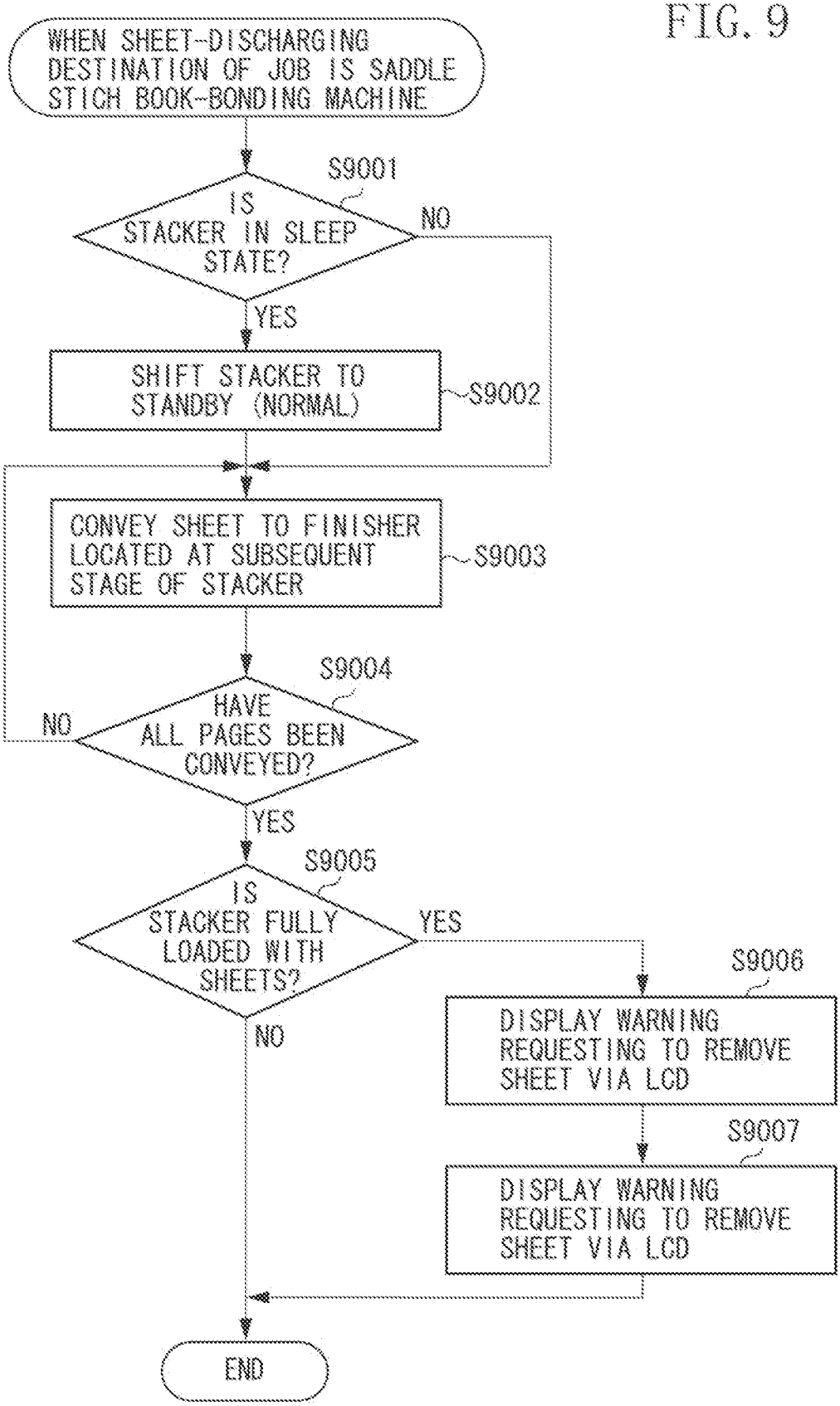
FIG. 9 is a flowchart illustrating a control method of the printing device.

FIG. 9 is a flowchart illustrating a control method of the printing device according to the present exemplary embodiment. FIG. 9 illustrates an example of the print processing of the digital multi-function processing machine 1000 in the printing system 3000 illustrated in FIG. 3. Particularly, as an example, the processing sequence when the paper discharging destination is the saddle stitch book-binding machine 3004 is described. The program of the digital multi-function processing machine 1000 described in the flow is stored in the program ROM of the main controller 30 or the external memory 121 such as the HDD 31, and read out to the RAM 113 to be executed by the CPU 112.

The main controller 30 receives the print job and outputs the print sheets to the specified output destination. A case where the output destination is the stacker will be described. In step S9001, the main controller 30 determines whether the large capacity stacker 3003 is in the sleep state based on the output capable destination list information managed by the main controller 30 itself. When the CPU 112 determines that the large capacity stacker 3003 is in the sleep state (YES in step S9001), then in step S9002, the large capacity stacker 3003 is recovered from the sleep state to the "on" state to be activated via the printer controller 32. To output the print sheets to the saddle stitch book-binding machine 3004 as shown in the printing system illustrated in FIG. 3, the printing system needs to pass the print sheets through the large capacity stacker 3003.

Thus, in step S9003, the main controller 30 returns the large capacity stacker 3003 to the "on" state to cause the large capacity stacker 3003 to convey the sheets to the saddle stitch book-binding machine 3004 located in a subsequent stage. The prints sheets passed through the large capacity stacker 3003 are stacked on the output tray of the stacker by the stacker controller 126. In step S9004, until the printing is completed on all pages required by the job, the main controller 30 repeatedly performs the processing in step S9003.

When the processing on the all pages is completed (YES in step S9004), then in step S9005, the CPU 112 of the main controller 30 determines the amount of the stacked printed sheets in the large capacity stacker 3003. When the CPU 112 determines that the large capacity stacker 3003 is fully loaded with the sheets (YES in step S9005), since the stacker cannot be used, in step S9006, the CPU 112 displays a guidance to prompt the user to remove the sheets in the large capacity stacker 3003 via the panel on the operation unit 120. In step S9007, the CPU 112 returns the power control to the state assumed before the job has been performed, to reduce the power consumption. With this arrangement, the large capacity stacker 3003 is set to the sleep mode.

[Removing Sheet from Large Capacity Stacker]

Figure 10:
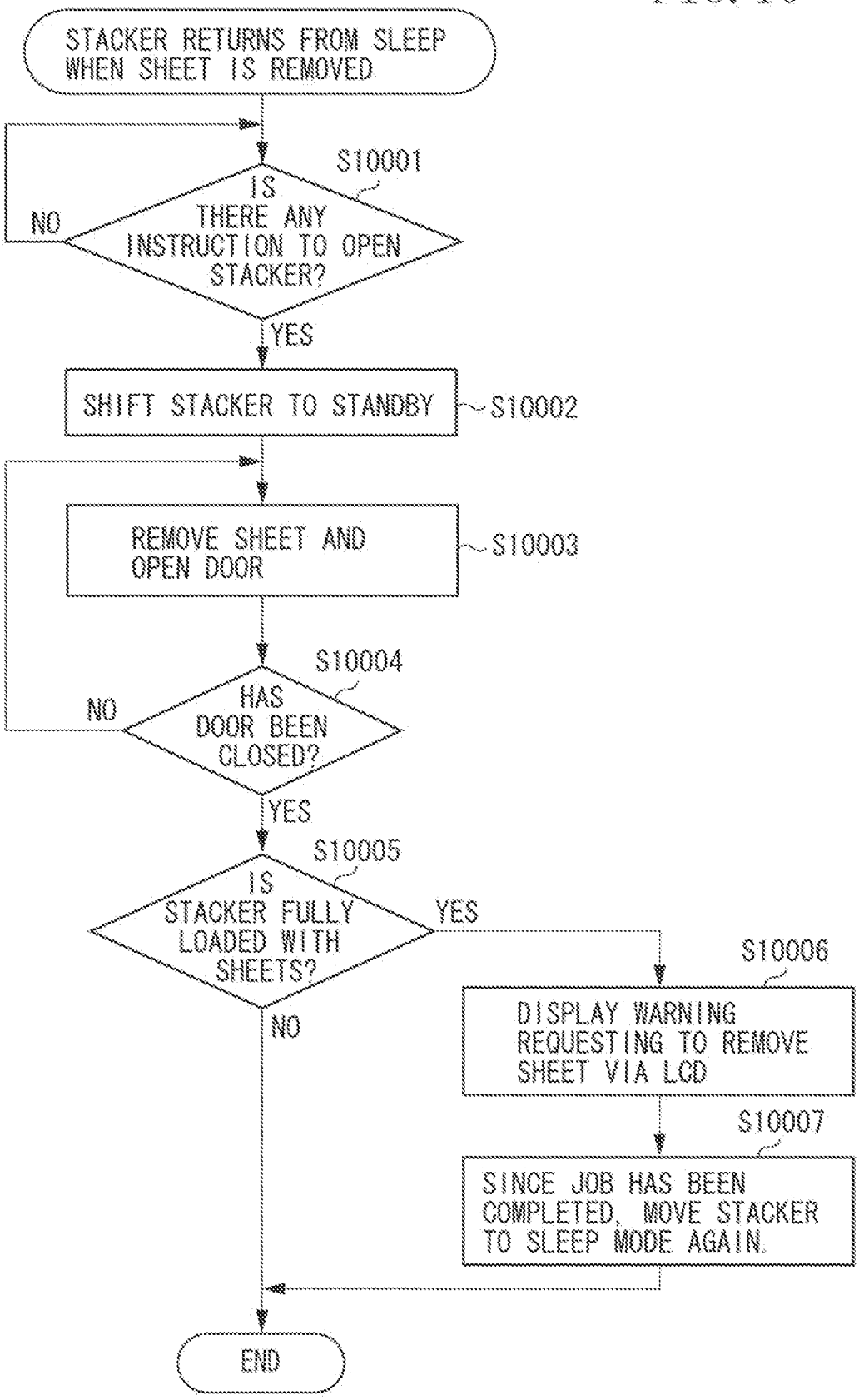
FIG. 10 is a flowchart illustrating a control method of the printing device.

FIG. 10 is a flowchart illustrating a control method of the printing device according to the present exemplary embodiment. FIG. 10 illustrates the print processing of the digital multi-function processing machine 1000 in the printing system 3000 illustrated in FIG. 3, and a processing example of removing the sheet from the large capacity stacker 3003. The program of the digital multi-function processing machine 1000 described in the flow is stored in the program ROM of the main controller 30 or the external memory 121 such as the HDD 31, and read out to the RAM 113 to be executed by the CPU 112. When it is determined that, after a cover opening/closing operation has been performed on the large capacity stacker 3003, the obtained amount of the stacked sheets exceeds the sheet stacking condition, the state of the power to be supplied to the large capacity stacker 3003 from the power source is shifted to the power saving state.

A front door of the large capacity stacker 3003 for removing the sheet is locked until an instruction for opening the door is received. Further, when the large capacity stacker 3003 is in the sleep mode, first, the stacker controller 126 needs to be activated from the main controller 30 via the printer controller 32.

In step S10001, the CPU 112 of the main controller 30 monitors a touch panel and a keyboard included in the operation unit 120 to detect a stacker open instruction from the operator. Upon receiving a cover open instruction from the operator, the main controller 30 activates the stacker controller 126 via the printer controller 32. In step S10002, the stacker controller 126 energizes each device of the large capacity stacker 3003 to recover the large capacity stacker 3003 to a stand-by state where the large capacity stacker 3003 can be activated.

Subsequently, in step S10003, the CPU 112 notifies the stacker controller 126 of the cover open instruction to unlock the front door. In step S10004, the stacker controller 126 waits for the operator to remove the printed sheet and close the front door. In step S10005, when the front door is closed, the stacker controller 126 lifts the tray lifter 4006 to determine whether any print sheet is left in the tray lifter 4006.

When the stacker controller 126 determines that the operator has not removed the sheet (YES in step S10005), the stacker controller 126 again detects that the tray lifter 4006 is fully loaded with the sheets. Since the stacker cannot be used when the tray lifter 4006 is fully loaded with the sheets, in step S10006, the CPU 112 displays a guidance again to remove the sheets stacked in the large capacity stacker 3003 via the panel on the operation unit 120. In step S10007, the CPU 112 returns the power control to the state assumed before the job has been performed to reduce the power consumption. With this arrangement, the large capacity stacker 3003 is set to the sleep mode again.

According to the first exemplary embodiment described above, the main controller 30 sets to the sleep mode the unit that cannot be used as the print output destination of the printing system. For example, when the large capacity stacker 3003 is fully loaded with the sheets, the main controller 30 sets the large capacity stacker 3003 to the sleep state. However, when a great amount of printing is performed without removing the sheets, all output destinations can be fully loaded with the sheets. In such a case, even if the device cannot be used, and even if a sleep timer function or an automatic shut-down timer function is previously set, the device does not act until time set to the timer elapses. Since the useless power is consumed in such a case, when none of the output destinations can be used, the power needs to be promptly reduced.

Figure 11:
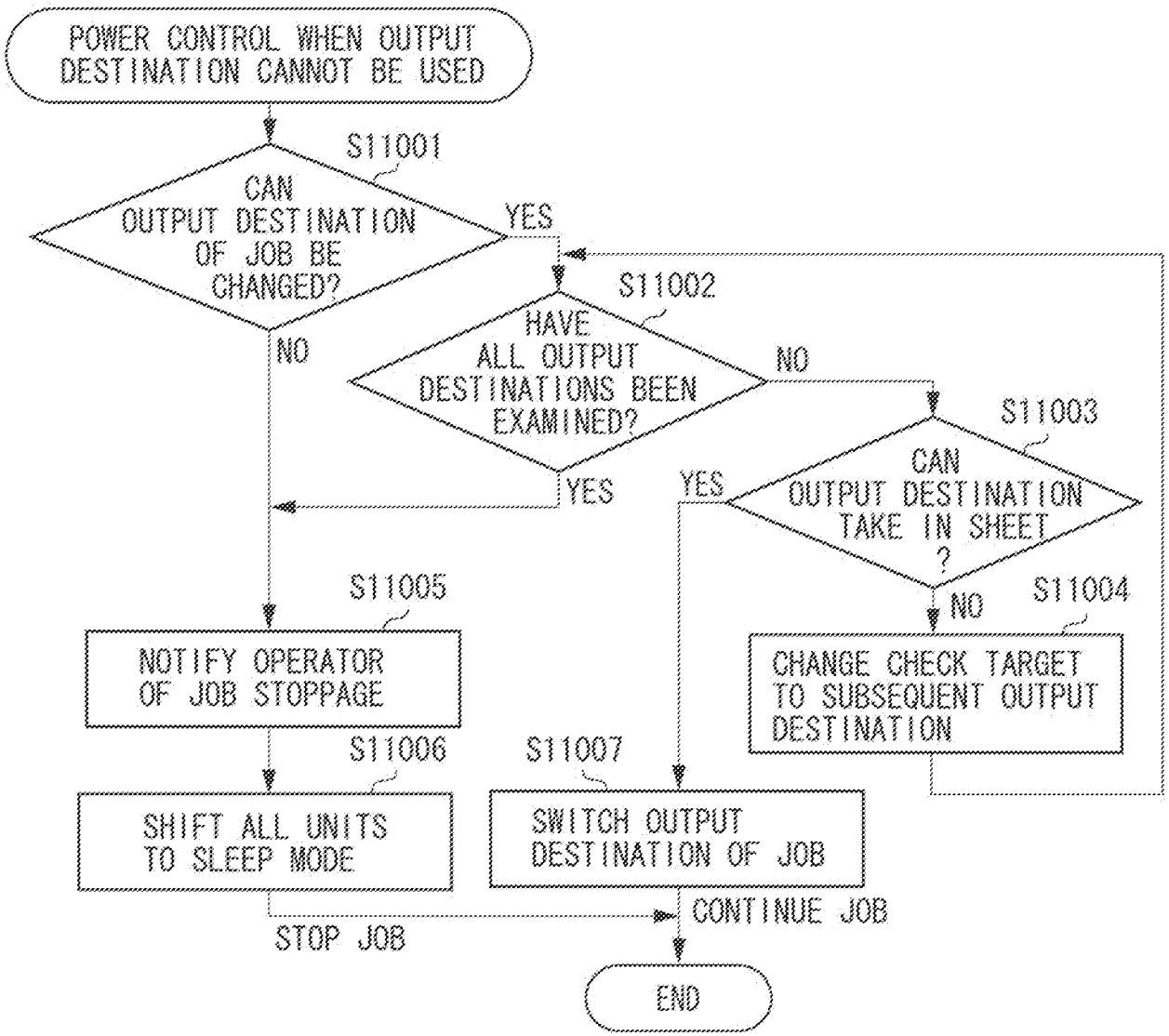
FIG. 11 is a flowchart illustrating a control method of the printing device.

Thus, the present exemplary embodiment will describe an example of a power control of the printing system when the print sheets can be output to none of the output destinations in the printing system having a single or a plurality of output destinations, with reference to a flowchart illustrated in FIG. 11. FIG. 11 is a flowchart illustrating a control method of the printing device according to the present exemplary embodiment. FIG. 11 illustrates an example of the power control of the printing system illustrated in FIG. 3. The program of the digital multi-function processing machine 1000 described in the flow is stored in the program. ROM of the main controller 30 or the external memory 121 such as the HDD 31, and read out to the RAM 113 to be executed by the CPU 112. The example describes the control when the printing system includes the option sheet deck 3002, the left deck 23, and the right deck 24, as a plurality of sheet feeding devices for feeding the sheets and further when the CPU 112 determines that there are no output destinations to which the sheets can be output. The CPU 112 shifts to the power saving state the state of the power supplied to the large capacity stacker 3003, and all of the option sheet deck 3002, the left deck 23, the right deck 24, and the digital multi-function processing machine 1000.

The main controller 30 performs determination processing illustrated in FIG. 11 upon detection of the fully stacking state of the output destination when the print job is performed. First, in step S11001, the main controller 30 determines whether the output destination of the job in operation can be changed. To facilitate to identify an operator's own job from other's job herein, some operator may fix the output to only a specific output destination. In such a case, since no output destination can be used, the printing system cannot be operated. To avoid unnecessary power consumption, the entire printing system is shifted to the sleep mode.

According to the present exemplary embodiment, the digital multi-function processing machine 1000 has a function (not illustrated) of notifying the operator distant from the printing system of a change of the job state. For example, the digital multi-function processing machine 1000 notifies the operator of the state of the device via an e-mail. In step S11005, the main controller 30 transmits the mail to an operator's e-mail address previously registered, to notify the operator that the device is set to the sleep state since the output destination of the printing system cannot be loaded with the print sheets.

In response to the notification, the operator can carry out operation such that the printing system can continue the print job. When it is determined that the output destination of the job can be changed (YES in step S11001), then in steps S11002, S11003, and S11004, the CPU 112 further sequentially determines whether the output destinations included in the printing system can be used as the output destination while sequentially changing a checking target. When the output destination that can be used as the output destination of the job is found (YES in steps S11002 and S11003), then in step S11007, the output destination of the job in progress is switched to the detected output destination to continue the job.

On the other hand, when the CPU 112 determines that none of the output destinations can be used in the sheet processing control group 3100 (NO in step S11002), then in step S11005, in a similar manner to step S11001 where the output destination of the job cannot be changed, the CPU 112 notifies the operator of stoppage of the job. Subsequently, the CPU 112 shifts the all units including the digital multi-function processing machine 3004 to the sleep mode to reduce the power consumption. The operator can press the power source button on the operation unit 120 to use the printing system again.

The above-described exemplary embodiment is not seen to be limiting, and modifications based on the embodiment can be performed, and are not excluded from the scope of the present disclosure.

Other Embodiments

Additional embodiments can also be realized by a computer of a system or apparatus that reads out and executes computer executable instructions recorded on a storage medium (e.g., computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-262218 filed Nov. 30, 2012, which is hereby incorporated by reference herein in its entirety.

What is claimed is:

1. A printing system including a printing device and a plurality of sheet stacking devices for stacking sheets on which images are printed by the printing device, comprising:

an obtaining unit configured to obtain an amount of stacked sheets from the plurality of sheet stacking devices;

a determination unit configured to determine whether the amount of the stacked sheets reaches a predetermined amount which is set as a maximum stacking amount; and a control unit configured (i) to cause, in a case where it is determined by the determination unit that the amount of the stacked sheets in one sheet stacking device among the plurality of sheet stacking devices reaches the predetermined amount, said one sheet stacking device to shift to a sleep state without causing the printing device to shift to the sleep state, and (ii) to cause, in a case where it is determined by the determination unit that the amount of the stacked sheets in each of all of the plurality of sheets stacking devices reaches the predetermined amount, said all of the plurality of sheet stacking devices and the printing device to shift to the sleep state.

2. The printing system according to claim 1, wherein the maximum stacking amount is individually set according to a thickness of a sheet.

3. A control method for controlling a printing system including a printing device and a plurality of sheet stacking devices for stacking sheets on which images are printed by the printing device, the control method comprising:

obtaining an amount of stacked sheets from the plurality of sheet stacking devices;

determining whether the obtained amount of the stacked sheets reaches a predetermined amount which is set as a maximum stacking amount; and (i) causing, in a case where it is determined in the determining that the amount of the stacked sheets in one sheet stacking device among the plurality of sheet stacking devices reaches the predetermined amount, said one sheet stacking device to shift to a sleep state without causing the printing device to shift to the sleep state, and (ii) causing, in a case where it is determined in the determining that the amount of the stacked sheets in each of all of the plurality of sheet stacking devices reaches the predetermined amount, said all of the plurality of sheet stacking devices and the printing device to shift to the sleep state.

4. A non-transitory computer readable storage medium for storing computer executable instructions for controlling a printing system including a printing device and a plurality of sheet stacking devices for stacking sheets on which images are printed by the printing device, the computer program comprising:

obtaining an amount of stacked sheets from the plurality of sheet stacking devices;

determining whether the obtained amount of the stacked sheets reaches a predetermined amount which is set as a maximum stacking amount; and (i) causing, in a case where it is determined in the determining that the amount of the stacked sheets in one sheet stacking device among the plurality of sheet stacking devices reaches the predetermined amount, said one sheet stacking device to shift to a sleep state without causing the printing device to shift to the sleep state, and (ii) causing, in a case where it is determined in the determining that the amount of the stacked sheets in each of all of the plurality of sheet stacking devices reaches the predetermined amount, said all of the plurality of sheet stacking devices and the printing device to shift to the sleep state.

* * * * *